US005408784A

United States Patent [19]

Wruck et al.

[11] Patent Number: 5,408,784

[45] Date of Patent: Apr. 25, 1995

[54] EXTERIOR GASKET FOR OPERABLE WINDOWS AND DOORS

[75] Inventors: Dale A. Wruck, Norcross; Fred A. Grunewald, Roswell, both of Ga.

[73] Assignee: Kawneer Company, Inc., Norcross, Ga.

[21] Appl. No.: 241,495

[22] Filed: May 12, 1994

[51] Int. Cl.[6] ..... E06B 7/16

[52] U.S. Cl. ..... 49/489.1; 49/496.1

[58] Field of Search ..... 49/489.1, 475.1, 496.1, 49/377

[56] References Cited

U.S. PATENT DOCUMENTS

| | | | |
|---|---|---|---|
| 3,385,001 | 5/1968 | Bordnew | 49/496.1 X |
| 3,448,543 | 6/1969 | Multer | 49/489.1 X |
| 3,535,824 | 10/1970 | Kessler | 49/489.1 X |
| 4,447,985 | 5/1984 | Weber et al. . | |
| 4,538,380 | 9/1985 | Colliander | 49/489.1 X |
| 5,005,317 | 4/1991 | Saint-Louis Augustin et al. | 49/496.1 |
| 5,056,263 | 10/1991 | Bies | 49/489.1 X |
| 5,174,065 | 12/1992 | Schlicht | 49/489.1 |

FOREIGN PATENT DOCUMENTS

| | | | |
|---|---|---|---|
| 2230811 | 10/1990 | United Kingdom | 49/489.1 |

OTHER PUBLICATIONS

Wausau brochure dated 1985 entitled *Aluminum Windows & Curtain Wall*-window products.

Wausau brochure (pp. A/46–A/50) entitled *Custom Operable.*

EFCO Corp. Window Sections Drawings (2 sheets) dated Apr. 1990 entitled *Shadowline Vertical Stacking & Mtg. Rail Vertical Ribbon Window System.*

*Primary Examiner*—Philip C. Kannan

*Attorney, Agent, or Firm*—Jones & Askew

[57] ABSTRACT

A gasket for mounting to a pivotably mounted structure such as an operable window or door is disclosed. The gasket comprises a rigid body member comprised of a first material. A flexible hinge is formed integrally with a lower portion of the rigid body member, the flexible hinge being formed of a second material which is less rigid than the first material comprising the rigid body member. A rigid wiper is formed integrally with a lower portion of the flexible hinge and extending downward therefrom, the rigid wiper being formed of a third material which is more rigid than the second material comprising the flexible hinge. The disclosed gasket reduces the amount of drag created as the window or door is operated, thereby facilitating operation of the window or door. The gasket reduces drag in two different respects: first, by minimizing the area of surface contact between the gasket and the adjacent structure; and second, by providing that the element which contacts the adjacent surface have a low coefficient of friction.

7 Claims, 4 Drawing Sheets

EXTERIOR GASKET FOR OPERABLE WINDOWS AND DOORS

TECHNICAL FIELD

The present invention relates generally to building construction and relates more specifically to an improved exterior gasket for operable windows and doors.

BACKGROUND OF THE INVENTION

Glazed wall constructions comprising operable windows or vents are well known. Such a window or vent typically has a "wiper" type gasket secured along its periphery to provide a weather seal between the window or vent and the surrounding structure. A problem often arises with such gaskets, however, in that they create too much drag as the window or vent is opened or closed, thereby making the window or vent difficult to operate. This drag is a function of two different characteristics of the gasket. First, to provide an adequate weather seal, the gasket is typically comprised of a relatively soft material which will have a high coefficient of friction. Second, not only the lower edge but also a significant portion of the interior surface of the gasket will contact the adjoining structure, and the increased contact surface area increases friction. On the other hand, if a more rigid material is selected for the gasket, the lower edge of the gasket may well not conform to the surface of the window sill, frame, or other adjacent structure. Further, a more rigid material would be unlikely to accommodate even minor variances in the clearance between the window or vent and its surrounding structure.

Thus there is a need for a gasket for operable windows and doors which reduces the amount of drag created as the window or door is operated.

There is a further need for an improved gasket for operable windows and doors which minimizes the area of surface contact between the gasket and the adjacent structure.

There is still a further need for a gasket for operable windows and doors which is comprised of a material which provides a continuous seal between the window or door and its surrounding structure while providing a low coefficient of friction.

SUMMARY OF THE INVENTION

Stated generally, the present invention comprises a gasket for operable windows and doors which reduces the amount of drag created as the window or door is operated, thereby facilitating operation of the window or door. The gasket reduces drag by minimizing the area of surface contact between the gasket and the adjacent structure. The gasket further reduces drag by providing that the element which contacts the adjacent surface have a low coefficient of friction.

Stated more specifically, the gasket for operable windows and doors comprises a rigid body member. A flexible hinge member is formed integrally with a lower portion of the rigid body member and is formed of a material which is less rigid than the material comprising the rigid body member. A rigid wiper portion is formed integrally with a lower portion of the flexible hinge member and extends downward therefore. The rigid wiper portion is formed of a material which is more rigid than the material comprising the flexible hinge member. The gasket further includes means for attaching the gasket to an edge of a window or door. In the disclosed embodiment, the attachment means comprises a spline formed integrally with the rigid body member and extending rearward therefrom. The spline has a plurality of barbs projecting from it which engage the walls of a channel defined in the window or door.

Thus it is an object of the present invention to provide an improved gasket for operable windows and doors.

It is a further object of the present invention to provide a gasket for operable windows and doors which reduces the amount of drag created as the window or door is operated.

A further object of the present invention is to provide an improved gasket for operable windows and doors which minimizes the area of surface contact between the gasket and the adjacent structure.

Still another object of the present invention is to provide a gasket for operable windows and doors which is comprised of a material which provides a continuous seal between the window or door and its surrounding structure while providing a low coefficient of friction.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
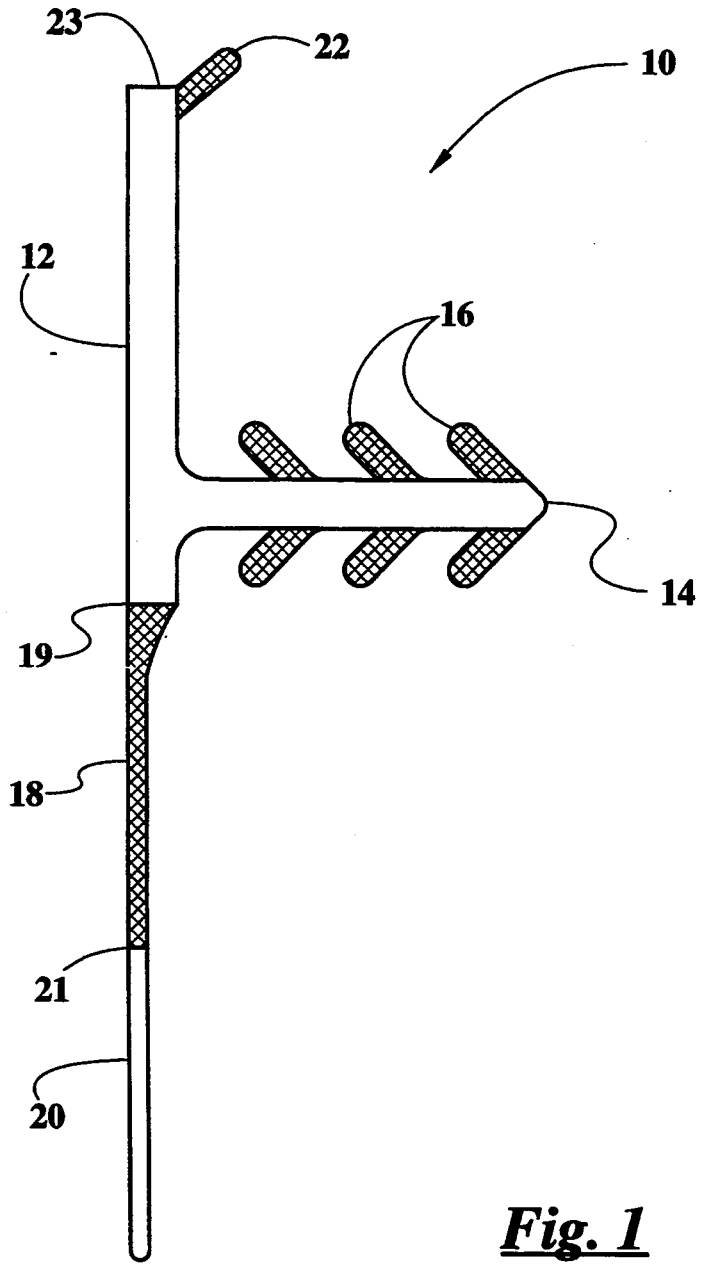
FIG. 1 is an end view of a gasket according to the present invention.

Referring now to the drawings, in which like numerals indicate like elements throughout the several views, FIG. 1 depicts a coextruded, dual-durometer gasket 10 according to the present invention. The gasket 10 comprises a rigid body member 12 having a rigid spline 14 projecting rearward therefrom. The spline 14 has a plurality of flexible, press-fit barbs 16 angling from its upper and lower surfaces back toward the rigid body member 12.

A flexible hinge 18 extends downward from the lower end 19 of the rigid body member 12. A rigid wiper 20 extends downward from the lower end 21 of the flexible hinge 18. A flexible watershed protrusion 22 extends upward and rearward from the upper end 23 of the rigid body member 12.

The rigid elements of the gasket 10—the body member 12, spline 14, and wiper 20—are comprised of a thermoplastic rubber such as Santoprene having a durometer hardness of about 50 on the Shore D scale. The flexible components—the press-fit protrusions 16, the flexible hinge 18, and the flexible watershed protrusion 22—are all comprised of a thermoplastic rubber such as Santoprene having a durometer hardness of about 64 on the Shore A scale. The various rigid and flexible elements are coextruded to form a unitary structure.

The gasket 10 is manufactured by conventional coextrusion techniques well known to those skilled in the art and so will be described herein only briefly. A plastic extrusion press apparatus is employed. Pellets of the different substrates are placed in separate screw presses, heated, and forced as molten material through separate cavities of the extrusion press apparatus. The different substrates are forced through different ports of an extrusion die and brought together as they exit the die to form a unitary extrusion.

Figure 2:
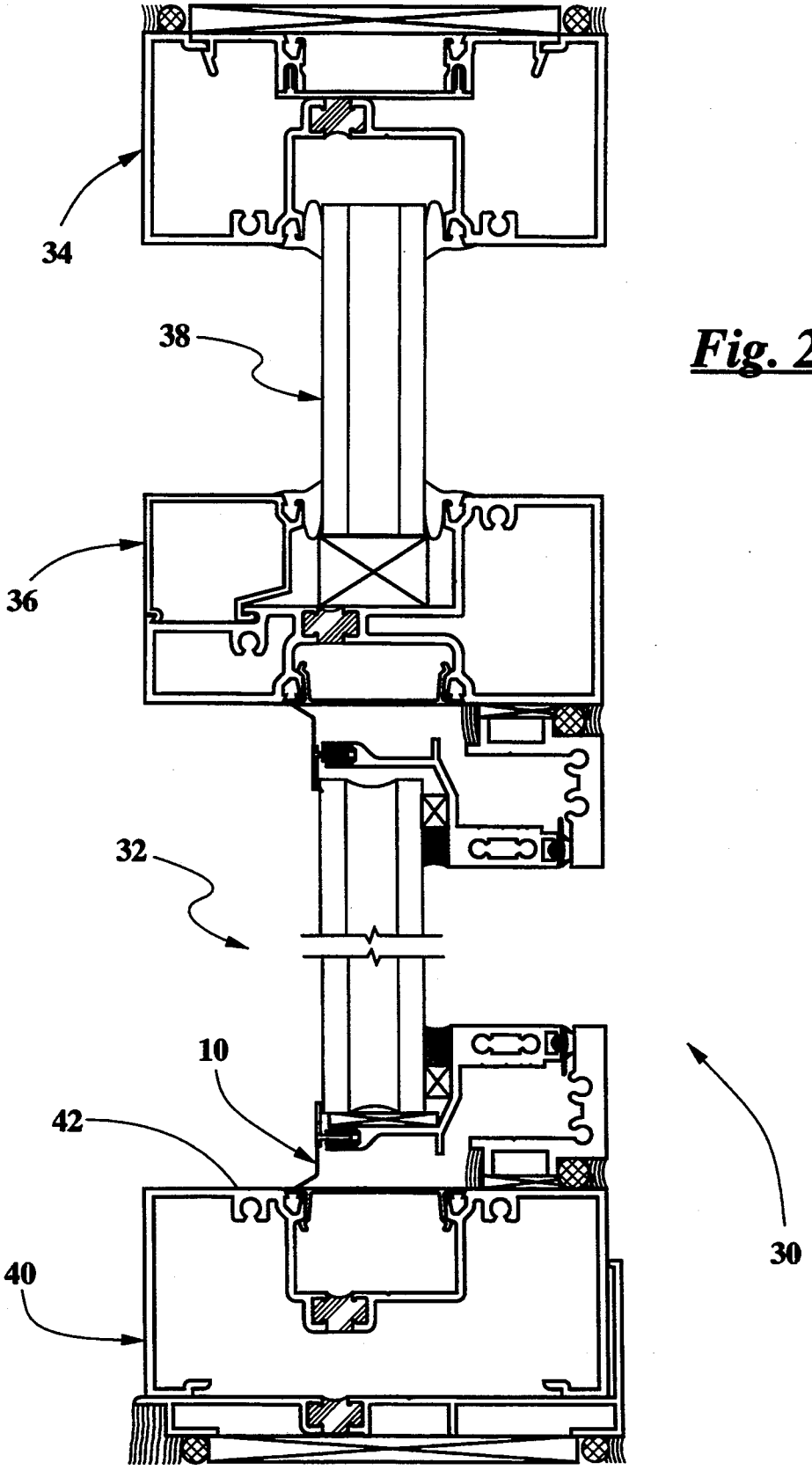
FIG. 2 is a side cutaway view of a glazed wall construction of a type with which the gasket of FIG. 1 is intended to be used.

FIG. 2 illustrates a glazed wall construction 30 having an operable vent 32. The glazed wall construction is comprised of a header mullion 34, an intermediate horizontal mullion 36, and a fixed window 38 whose lower end rests within a glazing pocket in the intermediate horizontal mullion 36 and whose upper end rests within a glazing pocket in the header mullion 34.

At the lower end of the glazed wall construction 30 is a footer mullion 40. The upper surface of the footer mullion 40 defines a sill 42. The operable vent 32 is hung between the intermediate horizontal mullion 36 and the footer mullion 40. Gaskets 10 are mounted along the exterior marginal edges of the operable vent 32 in a manner which will be described in conjunction with the discussion of FIG. 3 below. In the disclosed glazed wall construction 30, the operable vent 32 is of the "project-out" or bottom-opening design.

Figure 3:
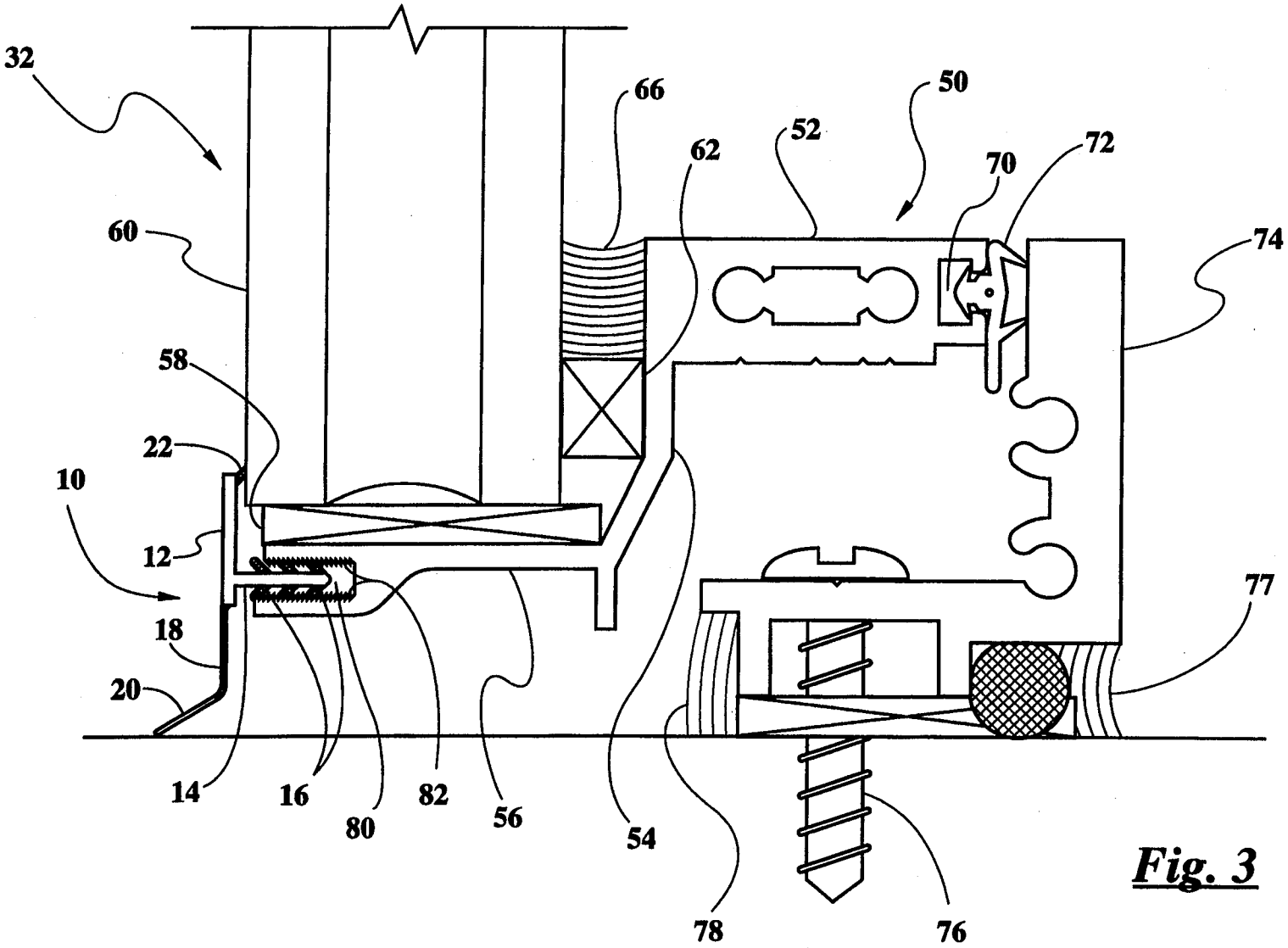
FIG. 3 is an enlarged view of a section of the glazed wall construction of FIG. 2.

Referring now to FIG. 3, the operable vent 32 comprises a vent frame member 50 having a main tubular portion 52, a vertical portion 54 depending downward from the forward end of the tubular portion 52, and a horizontal shelf 56 extending forward from the lower end of the vertical member 54. A setting block 58 rests on the upper surface of the shelf 56 and provides a support surface for the lower marginal edge of a glazing panel 60. The glazing panel 60 is spaced apart from the vertical member 54 by a structural silicone spacer 62 and is bonded to the vent frame member 50 by a structural silicone bead 66.

The vent frame member 50 defines a raceway 70 at its rearward edge which receives the head of an interior gasket 72. The interior gasket forms a seal between the vent frame member 50 and a window frame member 74 when the vent 30 is in its closed position. The window frame member 74 in turn is anchored to the sill 42 by means of screws 76 and is sealed by interior and exterior silicone beads 77, 78.

The vent frame member 50 further defines a forwardly opening channel 80 formed at the forward edge of the shelf 56. The upper and lower walls of the channel 80 have serrations 82. The spline 14 of the gasket 10 is inserted into the channel 80 and the face of the vent frame member 50, and the flexible barbs 16 engage the serrations 82 to prevent the gasket 10 from being pulled away from the vent frame 50. The angled orientation of the gaskets further secures the spline 14 within the channel 80. With the gasket thus installed, the rigid body member 12 of the gasket 10 covers the edge clearance of the glazing panel 60, and the flexible watershed protrusion 22 bears against a marginal edge of the exterior surface or the glazing panel 60 to direct water outwardly and down the exterior face of the gasket 10. The gasket 10 bends at the flexible hinge 18 as the rigid wiper 20 rests on the sill 42.

Figure 4:
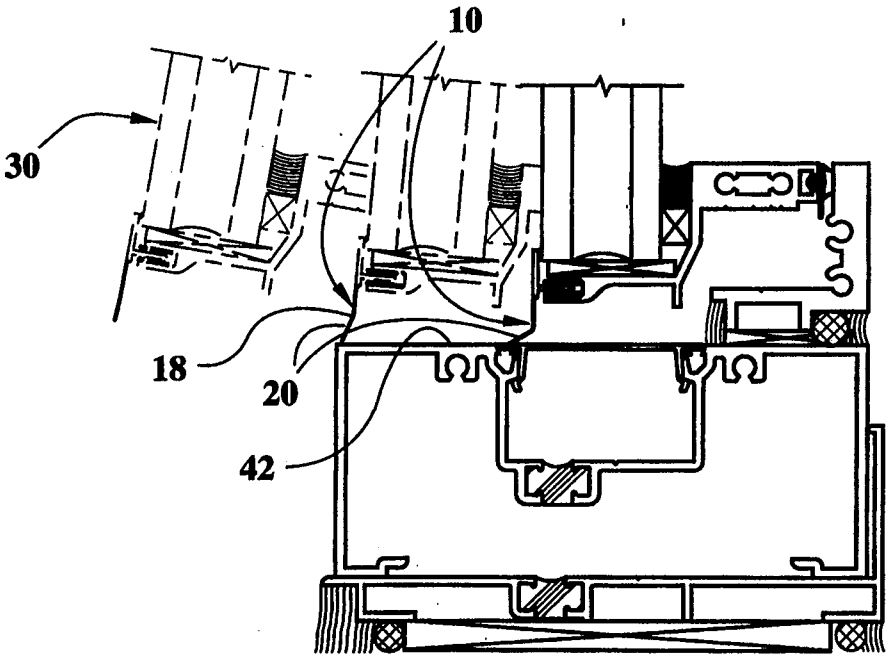
FIG. 4 is a side view of the lower portion of a bottom-opening vent of FIG. 2 showing the vent in its closed position (solid lines) and in various open positions (phantom lines) to illustrate the operation of the gasket as the vent is opened and closed.

Operation of the gasket 10 as the vent 30 is operated will now be explained with particular attention to FIG. 4. As the vent 30 is opened or closed, the lower end of the rigid wiper 20 is dragged across the sill 42. As can be seen, the gasket bends along the hinge 18 such that only the tip of the rigid wiper 20 contacts the sill 42. As the vent 30 pivots outward, the lower end of the vent pivots upward and away from the sill 42. As the distance between the lower end of the vent 30 and the sill 42 increases, the rigid wiper 20 pivots about the flexible hinge portion 18 such that the gasket 10 straightens as the hinge portion returns to its original straight configuration. As the lower end of the vent 30 pivots outward sufficiently to clear the sill 42, the lower end of the rigid wiper 20 is no longer contained by the sill, and the gasket 10 returns to its fully straight configuration as a result of the hinge section 18 straightening.

The features of the present invention afford numerous advantages over prior art window gaskets. The area of contact between the rigid wiper 20 of the gasket 10 and the sill 42 is minimal, essentially a single point of contact, thereby reducing drag between the wiper 20 and the sill 42. Also, because the gasket 10 flexes at the hinge 18 rather than at an intermediate location along the wiper 20, the back surface of the wiper does not contact the sill 42. Further, the relatively low coefficient of friction of the rigid material of the wiper 20 further minimizes drag as the vent 30 is operated. All of these features provide the advantage of reduced drag as the window or door is opened and closed, thereby facilitating operation.

Another advantage of the gasket 10 of the present invention is that the length of the flexible hinge 18 accommodates installation tolerances, in that the hinge point and the angle of the wiper 20 can change as the shim space between the lower end of the vent 32 and the sill 42 changes. Thus variations in the shim space do not compromise the sealing capability of the gasket and likewise do not create unnecessarily high drag as the window or door is opened and closed.

While the foregoing embodiment has been disclosed with respect to a gasket 10 comprised of thermoplastic rubber compositions of different hardnesses, it will be understood that the invention is by no means limited to these particular thermoplastic materials, and that other suitable flexible and rigid materials which can be coextruded can be adapted to the design of the gasket 10.

It will further be understood that while the foregoing embodiment has been disclosed with respect to a gasket 10 wherein all of the rigid components are comprised of a single material, the various rigid components can be coextruded from different rigid materials if desired. Similarly, while the flexible hinge, the flexible barbs, and the flexible watershed projection are all comprised of the same material, it will be appreciated that different types of flexible materials may be used so long as the various materials can be compatibly coextruded with the material or materials of the rigid components. It will further be appreciated that the flexible materials comprising the hinge, barbs, and watershed projection advantageously are resilient, whereby the memory characteristics of the flexible material will allow the flexible components to bend when subjected to force but will cause the flexible components to return to their original configuration when such forces are removed.

Although the gasket 10 has been disclosed with respect to rigid components comprised of a rigid material having a durometer hardness of about 50 on the Shore D scale, it has been found that materials having a hardness within a range of from about 30 to about 70 on the Shore D scale provide acceptable results. Similarly, while the flexible components of the disclosed embodiment have a durometer hardness of 64 on the Shore A scale, flexible materials having a durometer hardness of from about 40 to about 80 on the Shore A scale will provide acceptable results.

Further, while the disclosed embodiment has been described with respect to a gasket for an operable vent of the "project-out" or bottom-opening design, it will be appreciated that the gasket is equally well suited for use with side opening or "outswing casement" windows, and as a gasket for doors and other pivotably mounted structures requiring gaskets.

Finally, it will be understood that the preferred embodiment has been disclosed by way of example, and that other modifications may occur to those skilled in the art without departing from the scope and spirit of the appended claims.

What is claimed is:

1. A gasket for mounting to a pivotably mounted structure such as an operable window or door, comprising:

a rigid body member comprised of a first material;

a flexible hinge having first and second ends and being formed of a second material which is less rigid than said first material comprising said rigid body member;

a rigid wiper having first and second ends and being formed of a third material which is more rigid than said second material comprising said flexible hinge;

said first end of said flexible hinge being formed integrally with a portion of said rigid body member and said second end of said flexible hinge being formed integrally with said first end of said rigid wiper, and the second and of said rigid wiper comprising a free end; and means for attaching said gasket to an edge of a pivotably mounted structure.

2. The gasket of claim 1, wherein said means for attaching said gasket to an edge of a pivotably mounted structure comprises a spline formed integrally with said rigid body member and extending rearward therefrom, said spline having a plurality of barbs projecting therefrom for engaging walls defining a channel in said a pivotably mounted structure.

3. The gasket of claim 1, further comprising a flexible water dam formed integrally with an upper portion of said rigid body member and configured such that when said gasket is mounted to said pivotably mounted structure said flexible water dam engages a face of said pivotably mounted structure to deflect water away from said pivotably mounted structure.

4. The gasket of claim 1, wherein said first material and said third material comprise the same material.

5. The gasket of claim 1, wherein said first material and said third material have a hardness of from about 30 to about 70 on the Shore D scale.

6. The gasket of claim 1, wherein said second material comprises a material having a hardness of from about 40 to about 80 on the Shore A scale.

7. The gasket of claim 1, wherein said first, second, and third materials all comprise thermoplastic rubber.

* * * * *